US010100709B2

(12) United States Patent
Nakanishi

(10) Patent No.: US 10,100,709 B2
(45) Date of Patent: Oct. 16, 2018

(54) CONTROL DEVICE FOR ENGINE COOLING SYSTEM

(71) Applicant: DENSO CORPORATION, Kariya, Aichi-pref. (JP)

(72) Inventor: Daisuke Nakanishi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/564,277

(22) PCT Filed: Mar. 23, 2016

(86) PCT No.: PCT/JP2016/001667

§ 371 (c)(1),
(2) Date: Oct. 4, 2017

(87) PCT Pub. No.: WO2016/163088

PCT Pub. Date: Oct. 13, 2016

(65) Prior Publication Data

US 2018/0135502 A1 May 17, 2018

(30) Foreign Application Priority Data

Apr. 6, 2015 (JP) ..... 2015-077404

(51) Int. Cl.

| | |
|---|---|
| ***F01P 7/16*** | (2006.01) |
| *F01P 3/20* | (2006.01) |
| *F01P 7/14* | (2006.01) |

(52) U.S. Cl.
CPC . *F01P 7/16* (2013.01); *F01P 3/20* (2013.01); *F01P 2007/146* (2013.01); *F01P 2023/08* (2013.01); *F01P 2060/00* (2013.01)

(58) Field of Classification Search
CPC ..... F01P 7/14; F01P 2007/146; F01P 7/16; F01P 7/165
See application file for complete search history.

(56) References Cited

U.S. PATENT DOCUMENTS

| | | | | |
|---|---|---|---|---|
| 2003/0172882 | A1 | 9/2003 | Nakano | |
| 2015/0083057 | A1* | 3/2015 | Tsuchiya | F01P 7/14 123/41.08 |
| 2017/0022881 | A1 | 1/2017 | Matsumoto et al. | |

* cited by examiner

*Primary Examiner* — Jacob Amick
(74) *Attorney, Agent, or Firm* — Nixon & Vanderhye PC

(57) ABSTRACT

A control device is applied to an engine cooling system having a flow volume adjustment valve and a heat recovery unit. The control device includes a first learning unit which actuates a valve body to move to a valve-opening side by a predetermined amount at a time while a channel in the flow volume adjustment valve to the heat recovery unit is closed and learns a valve-closing position according to a coolant liquid that flows a circulation path and a second learning unit which actuates, after the valve-closing position is learned by the first learning unit, the valve body to move to the valve-opening side by a predetermined amount at a time within a range of a learned value while the channel is closed and determines to maintain the learned value and ends learning of the valve-closing position when the coolant liquid is not flowing the circulation path.

6 Claims, 5 Drawing Sheets

CONTROL DEVICE FOR ENGINE COOLING SYSTEM

CROSS REFERENCE TO RELATED APPLICATION

This application is the U.S. national phase of International Application No. PCT/JP2016/001667 filed Mar. 23, 2016 which designated the U.S. and claims priority to Japanese Patent Application No. 2015-77404 filed on Apr. 6, 2015, the entire contents of each of which are incorporated herein by reference.

TECHNICAL FIELD

The present disclosure relates to a control device for an engine cooling system.

BACKGROUND ART

According to an engine temperature controlling technique put into practical use, an engine temperature is controlled to be at a desirable temperature by letting an engine coolant liquid circulate through a heat recovery unit, for example, a radiator. More specifically, a flow volume adjustment valve adjusting a flow volume of an engine coolant liquid according to a position of a valve body is provided to a circulation path in which the engine coolant liquid circulates by passing through a heat recovery unit, and an engine temperature is controlled by adjusting the flow volume adjustment valve (see, for example, Patent Literature 1).

PRIOR ART LITERATURES

Patent Literature

Patent Literature 1: JP2003-269171A

SUMMARY OF INVENTION

In the flow volume adjustment valve, a valve-closing position of the valve body varies from product to product and with time. When the valve-closing position of the valve body varies, a flow volume of the coolant liquid may become too high or too low for the heat recovery unit. Such being the case, the valve-closing position is learned to constantly hold a precise valve-closing position. The valve-closing position is learned from a valve body position when the coolant liquid starts to flow in a circumstance where the valve body in a completely closed state is gradually opened. In such a case, however, the coolant liquid flows out to the heat recovering unit each time the valve-closing position is learned, which may possibly cause an inconvenience that the engine temperature falls unintentionally.

The present disclosure has an object to provide a control device for an engine cooling system capable of appropriately learning a valve-closing position of a flow volume adjustment valve while limiting an unintentional fall in engine temperature.

According to the present disclosure, the control device is applied to an engine cooling system having a flow volume adjustment valve adjusting a flow volume of a coolant liquid of an engine flowing a circulation path according to a position of a valve body provided to the circulation path of the coolant liquid, and a heat recovery unit provided downstream of the flow volume adjustment valve and recovering heat from the coolant liquid. The control device includes a first learning unit which actuates the valve body to move to a valve-opening side by a predetermined amount at a time while a channel in the flow volume adjustment valve to the heat recovery unit is closed and learns a valve-closing position of the flow volume adjustment valve according to the coolant liquid that flows the circulation path and a second learning unit which actuates, after the valve-closing position is learned by the first learning unit, the valve body to move to the valve-opening side by a predetermined amount at a time within a range of a learned value of the valve-closing position while the channel in the flow volume adjustment valve to the heat recovery unit is closed and determines to maintain the learned value and ends learning of the valve-closing position when the coolant liquid is not flowing the circulation path.

According to the configuration as above, the valve body is actuated to rotate to the valve-opening side within a range not exceeding presently the last learned value in a case where the learning is performed again after the learned value is calculated. In such a case, the valve body does not rotate over the learned value. Hence, the learning does not take an unnecessary long time and the learning can be finished as soon as possible. Hence, overheating of the engine caused by a delay in heat recovery in the heat recovery unit can be restricted. In addition, the valve body is not opened more than necessary while the valve-closing position is learned. Hence, recovering more heat than is necessary from a coolant liquid in the heat recovery unit can be limited, which can in turn restrict an unintentional fall in the engine temperature.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
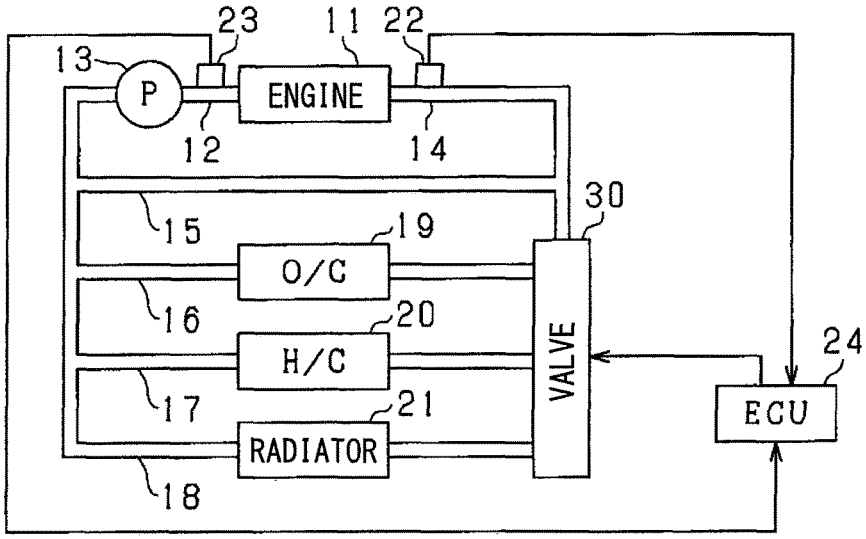
FIG. 1 is a view schematically showing a configuration of an engine cooling system.

Hereinafter, an engine cooling system equipped to a vehicle will be described as one embodiment showing the present disclosure by specific example. Firstly, a schematic configuration of the engine cooling system will be described according to FIG. 1. A water pump 13 forcing a coolant of an engine 11 to circulate is provided to an inlet channel 12 connected to an inlet side of a water jacket (coolant passage) of the engine 11. The water pump 13 is a mechanical water pump driven by power of the engine 11. Meanwhile, to an outlet channel 14 connected to an outlet side of the water jacket of the engine 11, a bypass channel 15 is connected directly and an oil cooler channel 16, a heater core channel 17, and a radiator channel 18 are connected via a flow volume adjustment valve 30.

The bypass channel 15 is a channel to let the coolant of the engine 11 circulate. The engine 11 in a cold state is warmed up by the circulating coolant. An oil cooler (O/C) 19 cooling oil, such as engine oil, a heater core (H/C) 20 used to warm up the engine 11, a radiator 21 releasing heat of the coolant are provided along the oil cooler channel 16, the heater core channel 17, and the radiator channel 18, respectively. The oil cooler 19, the heater core 20, and the radiator 21 correspond to a heat recovery unit. The respective channels 16 to 18 are channels to let the coolant of the engine 11 circulate via the corresponding heat recovery units 19 to 21. In the respective heat recovery units 19 to 21, heat is recovered from the coolant heated in the engine 11 by letting the coolant circulate. All of the channels 15 to 18 merge into one channel in front of the water pump 13 and the resulting one channel is connected to an inlet port of the water pump 13.

An outlet water temperature sensor 22 detecting an outlet water temperature Tw1, which is a temperature of the coolant flowing out from the engine 11, is provided to the outlet channel 14. An inlet water temperature sensor 23 detecting an inlet water temperature Tw0, which is a temperature of the coolant flowing into the engine 11, is provided to the inlet channel 12 of the engine 11. Besides the outlet water temperature sensor 22 and the inlet water temperature sensor 23, a water temperature sensor may be provided to each one of the channels 16 to 18.

Figure 2:
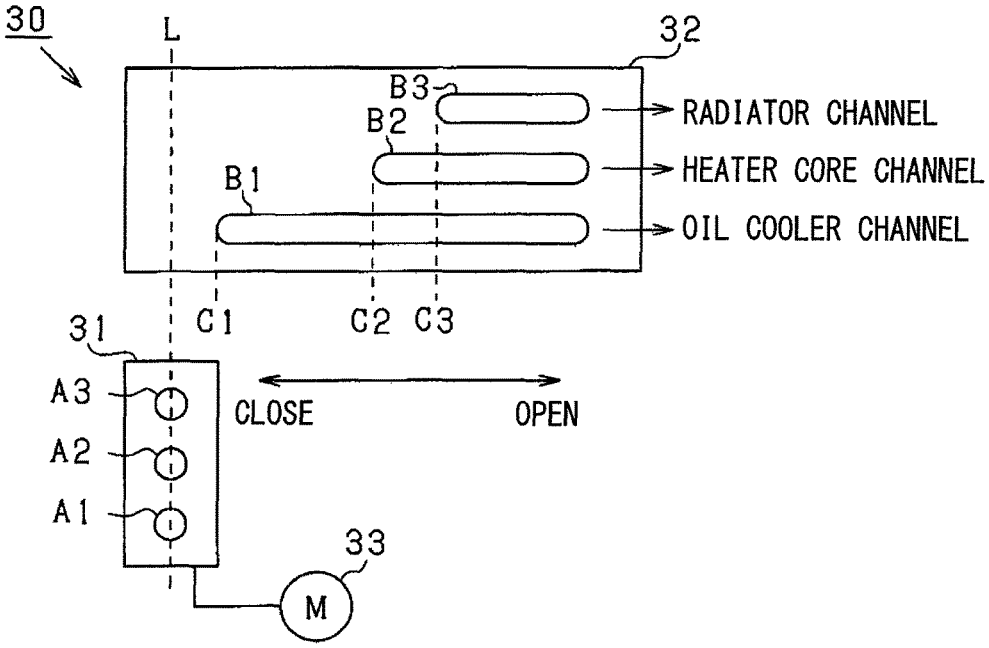
FIG. 2 is a schematic view showing a developed flow volume adjustment valve.

The flow volume adjustment valve 30 will now be described using a schematic view of FIG. 2. The flow volume adjustment valve 30 includes a rotor 31, a sleeve 32, and a motor 33. In FIG. 2, the flow volume adjustment valve 30 is exploded and developed. The rotor 31 and the sleeve 32 are of a circular-cylindrical shape about an axial line L. The rotor 31 is fit to an inner periphery of the sleeve 32 in a relatively rotatable manner. The rotor 31 corresponds to a valve body.

The rotor 31 is provided with ports A1, A2, and A3 connecting the outlet channel 14 to the channels 16 to 18, respectively. The port A1 is an inlet port to the oil cooler channel 16. The port A2 is an inlet port to the heater core channel 17. The port A3 is an inlet port to the radiator channel 18. The ports A1 to A3 are aligned side by side in the rotor 31 at regular intervals along a direction of the axial line L in order of the port A1, the port A2, and the port A3. The rotor 31 is driven to rotate by the motor 33 and the rotor 31 rotates relative to the sleeve 32 when the motor 33 is energized.

The sleeve 32 is provided with slits B1, B2, and B3 each extending in a circumferential direction. The slits B1 to B3 are aligned along the direction of the axial line L at intervals same as the intervals of the ports A1 to A3. Each of the slits B1 to B3 has a different opening length in the circumferential direction of the sleeve 32. More specifically, in the sleeve 32, the slits B1 to B3 are lined up along the direction of the axial line L at first ends (right side of FIG. 2) whereas ragged at second ends (left side of FIG. 2). An opening length is longest in the slit B1, sequentially followed by the slits B2 and B3.

A variance in communication states of the ports A1 to A3 with the slits B1 to B3, respectively, in association with rotations of the rotor 31 will now be described. When the rotor 31 rotates, positions of the respective ports A1 to A3 in the circumferential direction of the sleeve 32 move rightward from the positions on the left side of the drawing. When a rotation angle of the rotor 31 is a rotation starting angle C0, all of the ports A1 to A3 are closed. When a rotation angle of the rotor 31 reaches or exceeds C1, the port A1 communicates with the slit B1. When a rotation angle of the rotor 31 reaches or exceeds C2, the port A2 communicates with the slit B2. When a rotation angle of the rotor 31 reaches or exceeds C3, the port A3 communicates with the slit 63. Herein, C1 to C3 are angular positions in the flow volume adjustment valve 30, at which paths corresponding to the respective channels 16 to 18 in a closed state start to open, and referred to as valve-closing angles C1 to C3, respectively.

A relationship of a rotation angle of the rotor 31 and opening ratios of the ports A1 to A3, respectively, to the channels 16 to 18 will now be described using FIG. 3.

Figure 3:
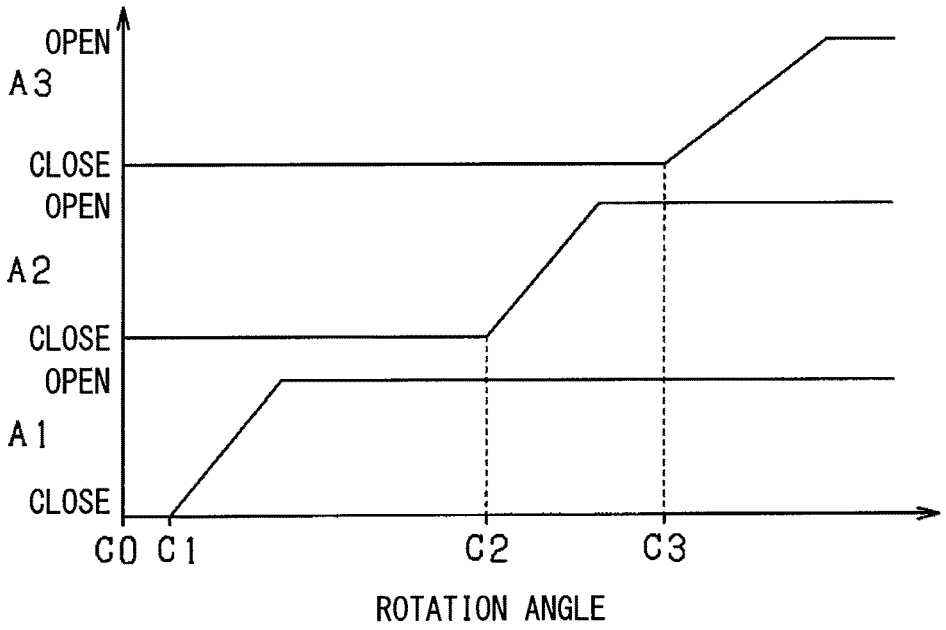
FIG. 3 is a chart showing a relationship between a rotation angle of a rotor and opening and closing states of respective ports.

As is shown in FIG. 3, from the rotation starting angle C0 to the valve-closing angle C1, opening ratios of the respective ports A1 to A3 are 0% and the coolant of the engine 11 does not flow any one of the channels 16 to 18. Hence, the coolant circulates in a path starting from the water jacket of the engine 11 and returning to the water jacket of the engine 11 by only passing through the outlet channel 14, the bypass channel 15, and the inlet channel 12. A path in the case above is referred to as a first path.

When a rotation angle of the rotor 31 increases and exceeds the valve-closing angle C1 of the oil cooler channel 16, the port A1 and the slit B1 communicate with each other. Hence, in addition to the path specified above, the coolant circulates in another circulation path passing through the oil cooler channel 16. The circulation path in the case as above is referred to as a second path. In a predetermined region where a rotation angle of the rotor 31 is greater than the valve-closing angle C1 of the oil cooler channel 16, an opening ratio of the port A1 increases as a rotation angle of the rotor 31 increases. Hence, a flow volume of the coolant in the oil cooler channel 16 increases.

A zone (a zone in which opening ratios of the respective ports A1 to A3 remain constant) in which an opening ratio of the port A1 is maintained at 100% and opening ratios of the other ports A2 and A3 are maintained at 0% is interposed before the port A2 and the slit B2 communicate with each other after an opening ratio of the port A1 reaches 100%.

That is, the port A2 and the slit B2 start to communicate with each other when a rotation angle of the rotor 31 increases further and exceeds the valve-closing angle C2 of the heater core channel 17. Hence, in addition to the paths specified above, the coolant circulates in still another circulation path passing through the heater core channel 17. A path in such a case is referred to as the second path. In a predetermined region where a rotation angle of the rotor 31 is greater than the valve-closing angle C2 of the heater core channel 17, an opening ratio of the port A2 increases as a rotation angle of the rotor 31 increases. Hence, a flow volume of the coolant in the heater core channel 17 increases.

A zone (a zone in which opening ratios of the respective ports A1 to A3 remain constant) in which the opening ratios of the ports A1 and A2 are maintained at 100% and an opening ratio of the other port A3 is maintained at 0% is interposed before the port A3 and the slit B3 communicate with each other after the opening ratio of the port A2 reaches 100%.

That is, when a rotation angle of the rotor 31 increases further and exceeds the valve-closing angle C3 of the radiator channel 18, the port A3 and the slit B3 start to communicate with each other. Hence, in addition to the paths specified above, the coolant circulates in still another circulation path passing through the radiator channel 18. A circulation path in such a case is referred to as the second path. In a predetermined region where a rotation angle of the rotor 31 is greater than the valve-closing angle C3 of the radiator channel 18, an opening ratio of the port A3 increases as a rotation angle of the rotor 31 increases. Hence, a flow volume of the coolant in the radiator channel 18 increases.

An ECU 24 chiefly includes a microcomputer formed of known components, such as a CPU, a ROM, and a RAM, and performs a water-temperature feedback control (f/b) and learning of valve-closing angles of the flow volume adjustment valve 30 according to various control programs prestored in the ROM.

In the water-temperature feedback control, flow volumes of the coolant flowing the respective channels 16 to 18 are controlled by the flow volume adjustment valve 30 in such a manner that the outlet water temperature Tw1 detected by the outlet water temperature sensor 22 coincides with a target temperature Ttg. A deviation of the outlet water temperature Tw1 from Ttg is calculated and an opening degree of the flow volume adjustment valve 30 is controlled according to a valve opening control amount of the flow volume adjustment valve 30 calculated from the deviation.

Figure 4:
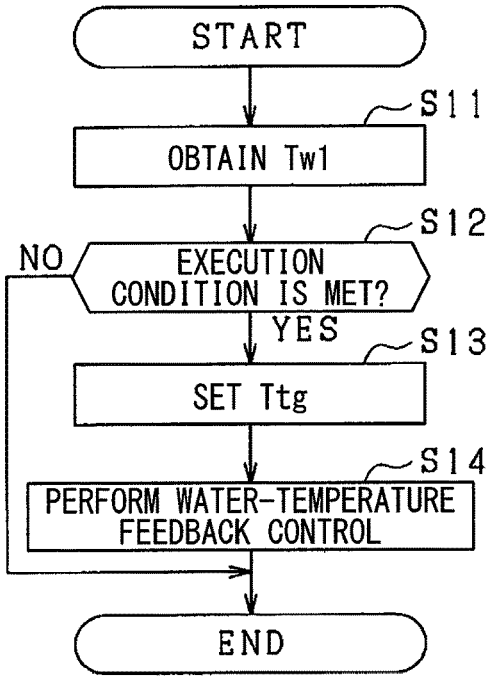
FIG. 4 is a flowchart depicting a processing procedure of water-temperature feedback.

The water-temperature feedback control performed by the ECU 24 will now be described using a flowchart of FIG. 4. The processing described below is performed repetitively in predetermined cycles by the ECU 24.

In S11, the outlet water temperature Tw1 is obtained. In the present embodiment, a processing process in S11 corresponds to an obtaining unit. In S12, a determination is made as to whether an execution condition of the water-temperature feedback control is met. It is preferable to determine the execution condition of the water-temperature feedback control according to communication states of the respective ports A1 to A3. More specifically, after the valve-closing angle C1 at or below which all of the ports A1 to A3 are closed is learned, it is preferable to perform the water-temperature feedback control when the outlet water temperature Tw1 reaches the target temperature Ttg. After the valve-closing angle C2 or C3 at or below which the port A1 or the ports A1 and A2 are opened is learned, it is preferable to perform the water-temperature feedback control when a predetermined time elapses while the outlet water temperature Tw1 remains at or above the target temperature Ttg.

When a negative determination (NO) is made in S12, the processing is ended. When a positive determination (YES) is made in S12, advancement is made to S13. In S13, the target temperature Ttg of the outlet water temperature Tw1 is set. In subsequent S14, the water-temperature feedback control is performed for the outlet water temperature Tw1 to coincide with the target temperature Ttg, and the processing is ended. In the present embodiment, processing processes in S13 and processing S14 correspond to a feedback control unit.

Valve-closing angle learning in the present embodiment will now be described. In the valve-closing angle learning, the respective valve-closing angles C1 to C3 are learned according to a variance in the outlet water temperature Tw1 occurring with rotations of the rotor 31. When a rotation angle of the rotor 31 exceeds the valve opening angles C1 to C3, the coolant circulates in the respective channels 16 to 18 and the outlet water temperature Tw1 varies. Hence, the respective valve-closing angles C1 to C3 can be learned by monitoring the outlet water temperature Tw1.

In the present embodiment, first learning and second learning are performed as the valve-closing angle learning. When the valve-closing angles are not learned at all, only the first learning is performed. When the first learning is already performed, the second learning is performed.

Figure 5:
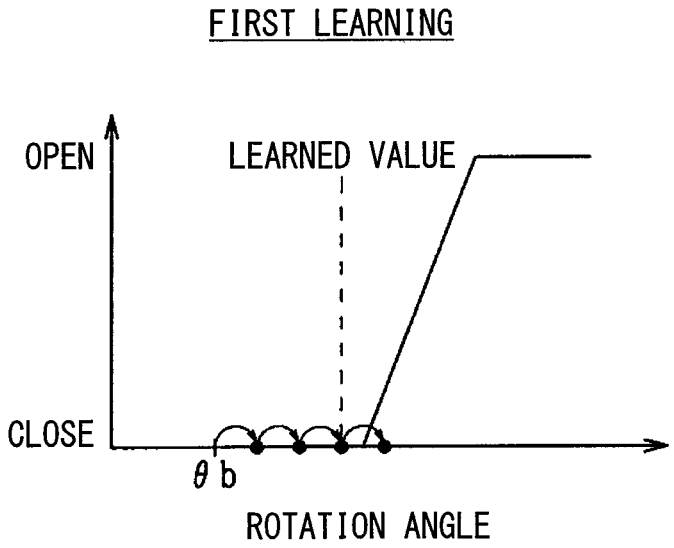
FIG. 5 is a view showing first learning.

The first learning will be described using FIG. 5. In the first learning, a rotation angle of the rotor 31 is varied to a valve-opening side by a predetermined amount at a time from an angular position (learning starting angle θb) when the flow volume adjustment valve 30 is closed to gradually displace at least one of the ports A1 to A3 toward the slits B1 to B3. It is preferable that the predetermined amount is a constant amount. Herein, each time a rotation angle of the rotor 31 is varied, a determination is made as to whether the outlet water temperature Tw1 has fallen because the path(s) in the flow volume adjustment valve 30 opens. When a fall in the outlet water temperature Tw1 is determined, a rotation angle of the rotor 31 immediately before a fall in the outlet water temperature Tw1 is learned as any corresponding one of the valve-closing angles C1 to C3.

In the first learning, the outlet water temperature Tw1 falls each time learning is performed. Hence, the engine temperature may fall unintentionally, in which case the engine 11 warms up late and fuel efficiency may be deteriorated. By taking such an inconvenience into consideration, the valve-closing angles C1 to C3 are learned in the second learning within a range of the last learned values obtained by the first learning.

Figure 6:
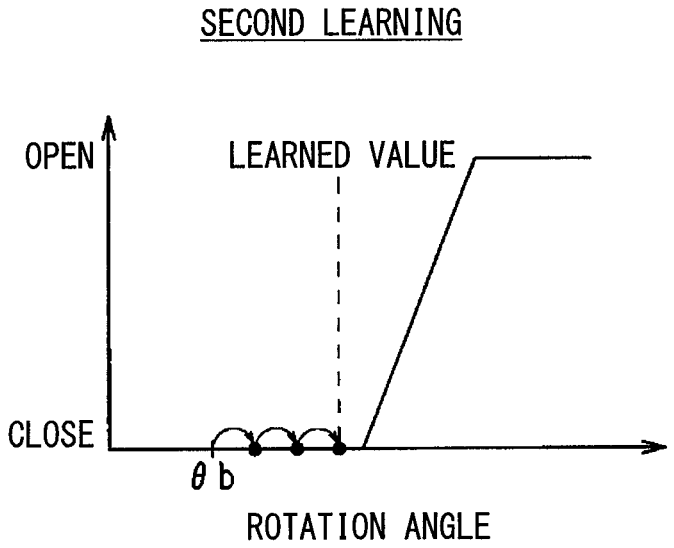
FIG. 6 is a view showing second learning.

The second learning will be described using FIG. 6. The second learning is different from the first learning in a range within which the rotor 31 is rotated. That is, in the second learning, a rotation angle of the rotor 31 is varied to the valve-opening side by a predetermined amount at a time within a range from the learning staring angle θb to the last learned value to gradually displace at least one of the ports A1 to A3 toward the slits B1 to B3. Herein, each time a rotation angle of the rotor 31 is varied, a determination is made as to whether the outlet water temperature Tw1 has fallen because the path(s) in the flow volume adjustment valve 30 opens. When a fall in the outlet water temperature Tw1 is not determined at a rotation angle up to the last learned value, the last learned value is maintained intact. Meanwhile, when a fall in the outlet water temperature Tw1 is determined at a rotation angle up to the last learned value, the learned value is updated by setting a rotation angle of the rotor 31 immediately before a fall in the outlet water temperature Tw1 as any corresponding one of the valve-closing angles C1 to C3.

In the second learning, the learned values are updated only when the actual valve-closing angles C1 to C3 vary to the valve-closing side from the last learned values. The learned values are not updated when the actual valve-closing angles C1 to C3 vary to the valve-opening side from the last learned values. Hence, when the actual valve-closing angles C1 to C3 vary to the valve-opening side from the valve-closing angles C1 to C3 recognized as the learned values after the first learning is performed, the learned values are maintained with a discrepancy. In such a case, when the port A1 to A3 in a closed state are opened by rotating the rotor 31, a wasteful time until the port A1 to A3 are actually opened becomes longer. Consequently, the coolant starts to flow the respective channels 16 to 18 with a delay and a water temperature may rise unintentionally. However, because the water-temperature feedback control is performed as described above, even when the water temperature rises unintentionally, such an inconvenience can be eliminated as soon as possible.

A processing procedure of the first learning and the second learning will now be described using a flowchart of FIG. 7. The processing described below is performed repetitively in predetermined cycles by the ECU 24.

Firstly, in S21, a determination is made as to whether an execution condition of the first learning or the second learning is met. It is preferable to perform the first learning and the second learning in a circumstance where a detection accuracy of the outlet water temperature Tw1 does not deteriorate. Hence, the execution condition includes a circumstance where a water temperature detection accuracy does not deteriorate. A condition that a water temperature detection accuracy does not deteriorate includes circumstances in which the vehicle is not in an environment where the coolant deteriorates, and so on, such as those where fuel is cut with deceleration, cylinders are at rest, the vehicle is running in an EV mode, heat generation in the engine 11 is not stopped or limited, the vehicle is running at a high speed, and outside air is in a cold atmosphere. An execution condition of each learning includes that a rotation position of the rotor 31 is in a predetermined zone in which opening ratios of the respective ports A1 to A3 remain constant at 0% or 100% independently of rotations of the rotor 31.

An execution condition of learning of the valve closing angel C1 performed when the flow volume adjustment valve 30 is driven from an initial position may preferably include that the outlet water temperature Tw1 is as high as or higher than a predetermined water temperature Th which is lower than the target temperature Ttg.

When a negative determination (NO) is made in S21, the processing is ended. When a positive determination (YES) is made in S21, advancement is made to S22. In S22, a determination is made as to whether the first learning is completed and the learned values of the respective valve-closing angles C1 to C3 are already obtained. When a negative determination (NO) is made in S22, advancement is made to S23, in which a series of processing processes is performed as the first learning. The learned values of the valve-closing angles C1 to C3 calculated by the first learning are stored appropriately in an internal memory of the ECU 24. In the present embodiment, a processing process in S23 corresponds to a first learning unit.

Meanwhile, when a positive determination (YES) is made in S22, advancement is made to S24, in which a series of processing processes is performed as the second learning. When no new learned value is calculated in the second learning, the last learned value is maintained intact and when a new learned value is calculated, the last learned value is updated by the new learned value. In the present embodiment, a processing process in S24 corresponds to a second learning unit.

Figure 8:
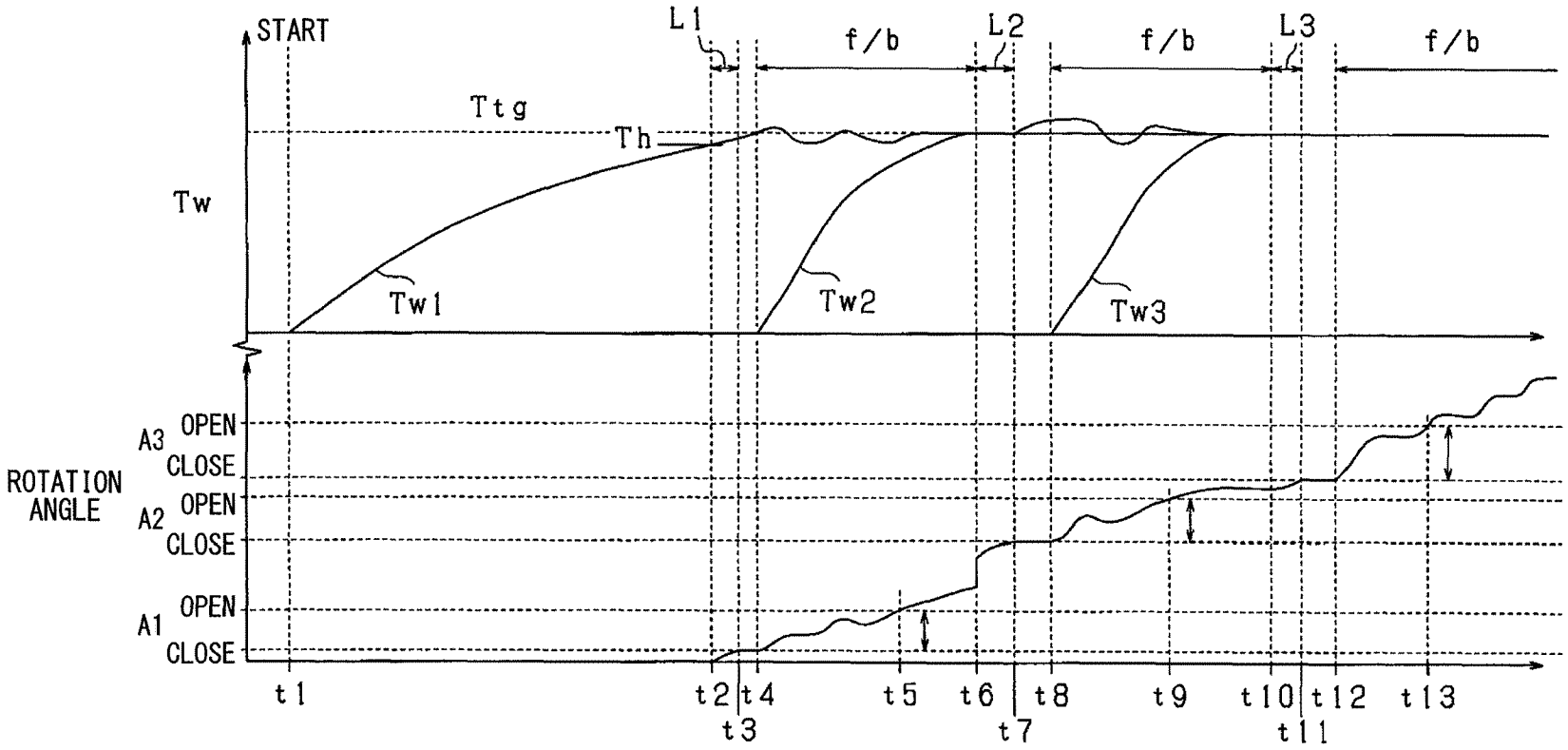
FIG. 8 is a time chart showing a simulation result of the second learning.

FIG. 8 is a time chart showing a simulation result of the second learning. FIG. 8 shows a temperature change of the coolant and a variance in rotor rotation angle with a time after an engine start. In FIG. 8, Tw2 is an outlet water temperature of the oil cooler 19 and Tw3 is an outlet water temperature of the heater core 20.

In FIG. 8, when the engine 11 is started at timing t1, the outlet water temperature Tw1 of the engine 11 starts to rise. Herein, all of the ports A1 to A3 are closed and the coolant heated in the engine 11 flows back into the engine 11 by passing through the bypass channel 15. The outlet water temperature Tw1 of the engine 11 thus rises. The outlet water temperature Tw1 of the engine 11 reaches the predetermined water temperature Th at timing t2. Then, second learning L1 to learn the valve-closing angle C1 is performed (t2 to t3). In the second learning L1, the valve-closing angle C1 is learned by varying a rotation angle of the rotor 31 within a range of the last learned value.

When the outlet water temperature Tw1 reaches the target temperature Ttg at timing t4, an opening ratio of the port A1 in the flow volume adjustment valve 30 is controlled by the water-temperature feedback control by which the outlet water temperature Tw1 is adjusted to coincide with the target temperature Ttg. Herein, the rotor 31 rotates to the valve-opening side to increase the opening ratio of the port A1. Accordingly, the coolant flows the oil cooler channel 16 and the outlet water temperature Tw2 of the oil cooler 19 rises. The port A1 fully opens (the opening ratio reaches 100%) at timing t5.

Subsequently, the water temperature feedback control is suspended at timing t6 and second learning L2 to learn the valve-closing angle C2 is performed (t6 to t7). In the second learning L2, the valve-closing angle C2 is learned by varying a rotation angle of the rotor 31 within a range of the last learned value.

Subsequently, the water-temperature feedback control is resumed at timing t8. The rotor 31 thus rotates to the valve-opening side to increase an opening ratio of the port A2. Accordingly, the coolant flows the heater core channel 17 and the outlet water temperature Tw3 of the heater core 20 rises. The port A2 fully opens (the opening ratio reaches 100%) at timing t9.

Subsequently, the water-temperature feedback control is suspended at timing t10 and second learning L3 to learn the valve-closing angle C3 is performed (t10 to t11). In the second learning L3, the valve-closing angle C3 is learned by varying a rotation angle of the rotor 31 within a range of the last learned value.

Subsequently, the water-temperature feedback control is resumed at timing t12. The rotor 31 thus rotates to the valve-opening side to increase an opening ratio of the port A3. Accordingly, the coolant flows the radiator channel 18. The port A3 fully opens (the opening ratio reaches 100%) at timing t13.

According to the present embodiment described in detail above, excellent effects as follows can be obtained.

According to the configuration as above, the rotor 31 is actuated to rotate to the valve-opening side within a range not exceeding presently the last learned value in a case where the learning is performed again after the learned value is calculated. In such a case, the rotor 31 does not rotate over the learned value. Hence, the learning does not take an unnecessary long time and the learning can be finished as soon as possible. Hence, overheating of the engine 11 caused by a delay in heat recovery in the heat recovery units 19 to 21 can be restricted. In addition, the rotor 31 is not opened more than necessary while the valve-closing angles C1 to C3 are learned. Hence, recovering more heat than is necessary from a coolant liquid in the heat recovery units 19 to 21 can be limited, which can in turn restrict an unintentional fall in the engine temperature.

According to the configuration as above, in the second learning, when the coolant flows the respective channels 16 to 18 while the rotor 31 is actuated to rotate to the valve-opening side within a range of the last learned values, the learned values are updated by the rotation angles of when the coolant flows. Hence, the valve-closing angles C1 to C3 can be recognized appropriately when the valve-closing angles C1 to C3 vary to the closing side from the last leaned values.

According to the configuration above, by letting the coolant start to flow the channels 16 to 18 one by one, the valve-closing angles C1 to C3 can be learned channel by channel while the coolant starts to flow more channels. In such a case, the coolant can flow and the valve-closing angle can be learned in series channel by channel until the coolant flows all of the channels 16 to 18.

According to the configuration as above, the water-temperature feedback control is performed when the flow volume adjustment value 30 opens. Hence, even when the water temperature rises unintentionally because the actual valve-closing angles C1 to C3 vary to the valve-opening side from the valve-closing angles C1 to C3 recognized as the learned values and the coolant starts to flow the respective channels 16 to 18 with a delay, such an inconvenience can be eliminated as soon as possible.

OTHER EMBODIMENTS

The embodiment above may be modified as follows.

In the embodiment above, the first learning is performed first as initial learning and subsequently the second learning is performed continuously. However, it may be configured in such a manner that the first learning may be performed in predetermined cycles after the first learning is performed last. When modified in the manner as above, the first learning is performed less frequently than the second learning.

Figure 7:
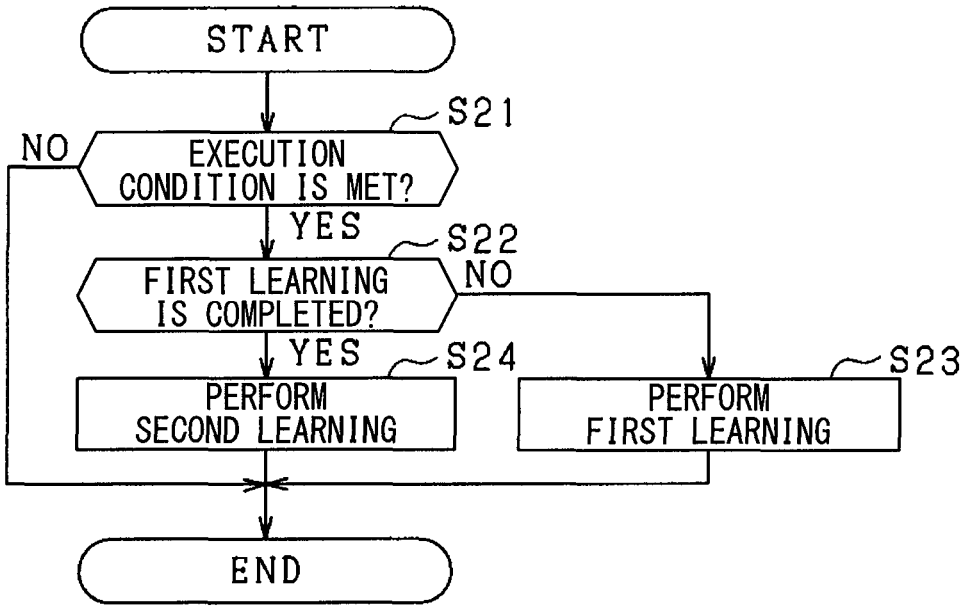
FIG. 7 is a flowchart depicting a processing procedure of the first learning and the second learning.

More specifically, in S22 of FIG. 7, in addition to making a determination as to whether the learned values by the first learning are already obtained, a determination is made as to whether it is a circumstance where a predetermined condition to perform the first learning again after the first learning is performed last is not met. To be more exact, how many times the second learning is performed following the first learning is counted, and it is determined that the predetermined condition is not met until the counted number of times reaches a predetermined value (two or greater), in which case advancement is made to S24. When the predetermined condition is met, a negative determination is made in S22 and advancement is made to S23. Alternatively, it may be configured in such a manner that the first learning is performed again when a vehicle travel distance or an elapsed time after the first learning is performed is equal to or greater than a predetermined value.

According to the modified configurations as above, by performing the second learning at a relatively high frequency while performing the first learning at a relatively low frequency, the valve-closing position learning can be performed more appropriately while limiting a fall in the engine temperature occurring when the valve-closing position of the flow volume adjustment valve 30 is learned.

In the embodiment above, the valve-closing position learning and the water-temperature feedback control are performed according to the outlet water temperature Tw1 detected by the outlet water temperature sensor 22. The configuration as above may be modified in such a manner that the valve-closing position learning and the water-temperature feedback control are performed, for example, according to a pressure of the coolant detected by a pressure sensor, a flow volume of the coolant detected by a flow volume sensor, or a pump rotation speed of the water pump 13.

In the embodiment above, an angular position of the rotor 31 is varied by a certain amount at a time when the first learning and the second learning are performed. The configuration as above may be modified in such a manner that an angular position of the rotor 31 is varied by, for example, a smaller amount as the angular position approaches the last learned value.

It may be configured in such a manner that a varying amount is set according to an engine running state or an external environment. For example, the varying amount may be reduced as an engine speed is increased. In a case where an electric water pump is used, the varying amount may be reduced as a pump rotation speed is increased. Alternatively, the varying amount may be reduced as an outside air temperature falls. Further, the varying amount may be reduced as the ports opening in the flow volume adjustment valve 30 become fewer.

The flow volume adjustment valve 30 is not limited to the configuration described above. For example, it may be configured in such a manner that the sleeve 32, which is on an outer side of the rotor 31 disposed coaxially with the sleeve 32, is used as the valve body and a rotation angle of the sleeve 32 is adjusted by the motor 33.

The valve-closing position learning and the water-temperature feedback control may be performed according to the inlet water temperature Tw0 of the engine 11 instead of the outlet water temperature Tw1 of the engine 11.

The coolant liquid of the engine 11 may be cooling oil or the like besides the coolant. The present disclosure is also applicable to systems other than in-vehicle systems.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A control device for an engine cooling system having a flow volume adjustment valve adjusting a flow volume of a coolant liquid of an engine flowing a circulation path according to a position of a valve body provided to the circulation path of the coolant liquid, and a heat recovery unit provided downstream of the flow volume adjustment valve and recovering heat from the coolant liquid, the control device comprising:

a first learning unit which actuates the valve body to move to a valve-opening side by a predetermined amount at a time while a channel in the flow volume adjustment valve to the heat recovery unit is closed and learns a valve-closing position of the flow volume adjustment valve according to the coolant liquid that flows the circulation path; and a second learning unit which actuates, after the valve-closing position is learned by the first learning unit, the valve body to move to the valve-opening side by a predetermined amount at a time within a range of a learned value of the valve-closing position while a channel in the flow volume adjustment valve to the heat recovery unit is closed and determines to maintain the learned value and ends learning of the valve-closing position when the coolant liquid is not flowing the circulation path.

2. The control device for the engine cooling system according to claim 1, wherein when the coolant liquid flows the circulation path while the second learning unit is actuating the valve body to move to the valve-opening side by the predetermined amount at a time within the range of the learned value of the valve-closing position, the second learning unit updates the learned value with a valve position of when the coolant liquid flows the circulation path.

3. The control device for the engine cooling system according to claim 1, wherein the circulation path splits to a first path and a second path, the flow volume adjustment valve is switched from a state in which the coolant liquid is flowing neither the first path nor the second path to a state in which the coolant liquid is only flowing the first path or to a state in which the coolant liquid is flowing the first path and the second path, and the first learning unit and the second learning unit learn the valve-closing position for the first path while the coolant liquid is flowing neither the first path nor the second path, and learn the valve-closing position for the second path while the coolant liquid is flowing the first path and is not flowing the second path.

4. The control device for the engine cooling system according to claim 1, further comprising:

an obtaining unit obtaining a detection temperature of the coolant liquid; and a feedback control unit performing a feedback control on an opening degree of the flow volume adjustment valve to control a temperature of the coolant liquid obtained by the obtaining unit to coincide with a predetermined target temperature.

5. The control device for the engine cooling system according to claim 1, wherein the first learning unit learns the valve-closing position in predetermined cycles instead of the second learning unit.

6. The control device for the engine cooling system according to claim 5, wherein the first learning unit learns the valve-closing position less frequently than the second learning unit learns the valve-closing position.

* * * * *